US012066235B2

(12) United States Patent
Jensen

(10) Patent No.: US 12,066,235 B2
(45) Date of Patent: Aug. 20, 2024

(54) ICE CUBE PRODUCING UNIT

(71) Applicant: ICEBREAKER International ApS, Aalborg (DK)

(72) Inventor: Kim Jensen, Aalborg SV (DK)

(73) Assignee: ICEBREAKER International ApS, Aalborg (DK)

( * ) Notice: Subject to any disclaimer, the term of this patent is extended or adjusted under 35 U.S.C. 154(b) by 0 days.

(21) Appl. No.: 18/512,772

(22) Filed: Nov. 17, 2023

(65) Prior Publication Data

US 2024/0085080 A1 Mar. 14, 2024

Related U.S. Application Data

(63) Continuation of application No. 17/295,960, filed as application No. PCT/EP2019/082332 on Nov. 22, 2019.

(30) Foreign Application Priority Data

Nov. 22, 2018 (DK) ..... PA201800900

(51) Int. Cl.
*F25C 1/243* (2018.01)

(52) U.S. Cl.
CPC ..... *F25C 1/243* (2013.01)

(58) Field of Classification Search
CPC ..... F25C 1/243; F25C 1/00; F25C 1/25
See application file for complete search history.

(56) References Cited

U.S. PATENT DOCUMENTS

| | | | |
|---|---|---|---|
| 1,971,879 | A | 8/1934 | Szaflr |
| 1,976,147 | A | 10/1934 | Smith |
| 2,083,081 | A | 6/1937 | Moll |

(Continued)

FOREIGN PATENT DOCUMENTS

| | | | |
|---|---|---|---|
| CH | 579894 | | 9/1976 |
| CN | 102878743 | A | 1/2013 |

(Continued)

OTHER PUBLICATIONS

First Search issued in corresponding Chinese application No. CN113227682A, issued on Jun. 10, 2022.

(Continued)

*Primary Examiner* — Kun Kai Ma
(74) *Attorney, Agent, or Firm* — Bookoff McAndrews, PLLC

(57) ABSTRACT

An ice cube producing unit comprising a tray formed as an ice cube tray having at least one ice cube compartment, a lid which is suitable for being mounted on the tray to seal contents of the at least one ice cube compartment inside said at least one ice cube compartment, a displacing mechanism connecting the tray and the lid and having two positions: a closed position where the lid is held in a position where it abuts the tray and an open position where the lid is held in a position where it is separated from the tray so that an ice cube formed in the tray can leave the tray. The displacing mechanism comprises a bi-stable element arranged between the lid and the tray, said bi-stable element having a first stable state when the tray and the lid are in the closed position and a second stable state when the tray and lid are in the open position. In this way, a simple construction is provided which is easy to use and has a simple displacing mechanism.

20 Claims, 7 Drawing Sheets

(56) References Cited

U.S. PATENT DOCUMENTS

| | | | |
|---|---|---|---|
| 2,341,700 | A | 2/1944 | Diack et al. |
| 2,587,852 | A | 3/1952 | Jahn et al. |
| 2,596,021 | A | 5/1952 | Gaugler |
| 2,613,512 | A | 10/1952 | Gaugler |
| 3,306,567 | A | 2/1967 | Frei |
| 3,374,982 | A | 3/1968 | Sallade |
| 3,414,229 | A | 12/1968 | Norberg |
| 3,443,785 | A | 5/1969 | Ewers |
| 3,776,504 | A | 12/1973 | Wiley |
| 4,366,941 | A | 1/1983 | Harris |
| 4,635,817 | A | 1/1987 | Kostov |
| 4,804,083 | A | 2/1989 | Weeks |
| 4,813,646 | A | 3/1989 | Fujio |
| 4,883,251 | A | 11/1989 | Manas |
| 4,967,995 | A | 11/1990 | Burgess |
| 5,188,744 | A | 2/1993 | Silverman |
| 5,196,127 | A | 3/1993 | Solell |
| 5,397,097 | A | 3/1995 | Dale |
| 5,711,892 | A | 1/1998 | Ramirez |
| 5,830,379 | A | 11/1998 | Tunzi |
| 6,196,518 | B1 | 3/2001 | Garrido-Lecca et al. |
| 7,172,087 | B1 | 2/2007 | Axe et al. |
| 2005/0151049 | A1 | 7/2005 | Lion et al. |
| 2006/0266915 | A1 | 11/2006 | Parker |
| 2007/0164192 | A1 | 7/2007 | Holden et al. |
| 2011/0278430 | A1 | 11/2011 | Barno |
| 2017/0363338 | A1 | 12/2017 | Jensen |
| 2020/0064047 | A1 | 2/2020 | Jensen |
| 2021/0055028 | A1 | 2/2021 | Jensen |

FOREIGN PATENT DOCUMENTS

| | | | |
|---|---|---|---|
| CN | 107003054 | A | 8/2017 |
| DE | 10135206 | C2 | 2/2003 |
| DE | 202006006940 | U1 | 7/2006 |
| EP | 1074801 | A2 | 2/2001 |
| EP | 2530413 | A2 | 12/2012 |
| GB | 1441520 | A | 7/1976 |
| GB | 2205637 | A | 12/1988 |
| GB | 2405689 | A | 3/2005 |
| JP | 2001021244 | A | 1/2001 |
| KR | 20110072367 | A | 6/2011 |
| WO | 2014102042 | A1 | 7/2014 |
| WO | 2016055495 | A2 | 4/2016 |
| WO | 2018202874 | A1 | 11/2018 |

OTHER PUBLICATIONS

International Search Report in PCT/EP2019/082332 dated Jun. 26, 2020 (5 pages).

Search Report issued in European Application No. 23180354, mailed on Jun. 30, 2023.

ICE CUBE PRODUCING UNIT

CROSS-REFERENCE TO RELATED APPLICATIONS

This application is a continuation of U.S. application Ser. No. 17/295,960, filed on May 21, 2021, which is incorporated herein by reference, and said U.S. application Ser. No. 17/295,960 is the U.S. national phase entry under 35 U.S.C. § 371 of International Application No. PCT/EP2019/082332, filed on Nov. 22, 2019, which claims benefit to Denmark Patent Application No. PA201800900, filed Nov. 22, 2018.

The current invention relates to an ice cube producing unit comprising a tray in the form of an ice cube tray having at least one ice cube compartment, a lid which is suitable for being mounted on the tray to seal contents of the at least one ice cube compartment inside said at least one ice cube compartment and a displacing mechanism connecting the tray and the lid and having two positions: a closed position where the lid is held in a position where it abuts the ice cube tray and an open position where the lid is held in a position where it is separated from the tray so that an ice cube formed in the tray can leave the tray.

By ice cube producing unit is meant a unit into which water or other liquid can be filled after which it is placed in a freezer and the water or other liquid freezes. Inside the unit, at least one ice cube compartment is arranged in which the ice freezes into an ice cube. By ice cube is meant any 3D geometric shape formed of ice. In other words, ice cubes do not have to be cubes with essentially rectangular sides as known in the art, but could be any other form, for example hearts, stars, spheres, ovals, etc. . . .

In a preferred embodiment of the invention, the ice cube producing unit according to the invention is a handheld unit. In the context of the invention, a "handheld" unit should be understood as a unit which is portable and which can be operated by hand. More specifically, a handheld ice cube dispensing unit according to the invention should be able to be placed in a typical household freezer. It should furthermore be possible to remove the unit from the freezer so that it can be manually operated by a user to remove ice cubes from the unit, after which it can be placed back into the freezer. In one embodiment, a handheld ice cube producing unit could be defined as being a unit which occupies a volume less than 4 Litres, less than 2.5 Liters, less than 2 liters or less than 1.5 liters.

DESCRIPTION OF RELATED ART

Ice cube trays with lids are well known in the art. For example: U.S. Pat. Nos. 5,188,744A, 2,613,512A, 5,196,127A and 4,967,995A. However prior art systems are either complex to use, have lids which need to be handled separately from the tray and/or do not seal the water properly inside the unit.

Furthermore, most of the ice cube trays with lids which are available in the art, are purely designed to enable stacking of ice cube trays on top of each other or to prevent odors from getting into the ice cubes. They are not designed to seal water/liquid inside the unit.

Applicant's own prior filed patent applications are more relevant and disclose different aspects of hand held ice cube producing units. Applicant's first PCT application published as WO2016/055495 is incorporated by reference in its entirety here. Applicant's second PCT application, not yet published, having application number PCT/EP2018/061554 and filed Apr. 5, 2018 is also incorporated by reference in its entirety here. Applicant's own prior patent applications disclose hand held ice cube producing units with lids and trays, where the tray is held connected to the lid during normal operation. However, the units specifically disclosed in applicant's own prior patent applications are hand held ice cube producing units which rely on a displacing mechanism comprising a number of moving mechanical parts.

Summary of the First Invention

It is therefore a first aspect of the invention to provide an ice cube producing unit with a novel displacing mechanism which has advantages over the prior art.

A second aspect of the invention is to provide an ice cube producing unit with a more simple displacing mechanism.

A third aspect of the invention is to provide an ice cube producing unit which comprises fewer moving mechanical parts and is cheaper to manufacture than prior art units.

This aspect is provided by an ice cube producing unit as mentioned in the introductory paragraph which is characterized in that the displacing mechanism comprises a first bi-stable element arranged between the lid and the tray, said first bi-stable element having a first stable state when the tray and the lid are in the closed position and a second stable state when the tray and lid are in the open position. In this way, a very simple mechanism is provided which is cheap to manufacture, very robust and easy to understand and operate for the user. Bi-stable elements are known from other applications, for example from folding plastic bathtubs, folding plastic cups, eye glass cases, etc. . . .

It is assumed that the term bi-stable element is clear to the person skilled in the art. However, for the sake of clarity, a bi-stable element can be defined as an element which has two stable positions. When placed in the first stable position, the bi-stable element will rest in that position. The bi-stable element can then be deformed and put into a second stable position. When the bi-stable element is in the second stable position, it will rest in that position. FIGS. 22-24 disclose some very schematic examples of bi-stable elements. It should be noted that the bi-stable behaviour of the bi-stable element is in many cases, due to a combination of the bi-stable element itself and how it is connected to other components. This is described in more detail with respect to FIGS. 22-24.

In one embodiment, the tray comprises at least two ice cube compartments, at least three ice cube compartments or at least four ice cube compartments. In one embodiment, in the closed position, the lid abuts the tray to seal contents of the at least one ice cube compartment inside the at least one ice cube compartment.

In one embodiment, in the open position, the shortest distance between the inside surfaces of the lid and the tray along a vector which is perpendicular to the plane of the lid is greater than the maximum distance between the inside surfaces of the lid and the tray in the closed position along a vector which is perpendicular to the plane of the lid. In this way, when the ice cube producing unit is opened, an ice cube formed in an ice cube compartment can exit the compartment and slide out of the ice cube producing unit between the lid and the tray.

In one embodiment, the vector difference D between the vector A which connects the centre of mass of the lid and the centre of mass of the tray in the closed position and the vector B which connects the centre of mass of the lid and the centre of mass of the tray in the open position comprises a major component which is perpendicular to the plane of the lid. In one embodiment, the length of said vector D is greater than 15 mm, greater than 20 mm, greater than 25 mm or greater than 30 mm. In one embodiment, the length of said vector is greater than the longest dimension perpendicular to the plane of the lid connecting the inside surfaces of the lid and the tray in the closed position. In one embodiment, the length of said vector D is less than 60 mm, less than 50 mm or less than 45 mm.

In one embodiment the vector which connects the centre of mass of the lid between the open and closed positions comprises a major component which is perpendicular to the plane of the lid. In one embodiment the length of said vector is greater than 10 mm, greater than 15 mm, greater than 20 mm or greater than 25 mm. In one embodiment the vector which connects the centre of mass of the tray between the open and closed positions comprises a major component which is perpendicular to the plane of the lid. In one embodiment the length of said vector is greater than 10 mm, greater than 15 mm, greater than 20 mm or greater than 25 mm.

In one embodiment, the displacing mechanism further comprises a second bi-stable element arranged between the lid and the tray, said second bi-stable element having a first stable state when the tray and the lid are in the closed position and a second stable state when the tray and lid are in the open position. In one embodiment, the first and second bistable elements are arranged in series between the lid and the tray.

In one embodiment, the displacing mechanism further comprises a frame element arranged to extend around the periphery of the tray and the lid, said first bi-stable element being arranged between the frame element and the tray and said second bi-stable element being arranged between the frame element and the lid. In this way, a stiff central construction can be provided by the frame element to which the bi-stable elements can be connected. This also provides a nice visual impression via the frame element arranged around the lid and tray. The frame element also provides a good location for a resealable opening through which liquid water can be poured into the ice cube producing unit and frozen ice cubes can be shaken out of the unit. In one embodiment, the frame element has a plane of symmetry. In one embodiment, the frame element has a plane of symmetry and the first bi-stable element is arranged on a first side of the plane of symmetry and the second bi-stable element is arranged on a second side of the plane of symmetry.

In one embodiment, the frame element is stiffer than the bi-stable elements. In one embodiment, the frame element is at least twice as stiff as the bi-stable elements. In one embodiment, the shore hardness of the material of the frame element is at least two times the shore hardness of the material of the bi-stable elements.

In one embodiment, the frame element and the bi-stable elements are co-injected as two steps of an injection moulding operation. In one embodiment, the bi-stable elements are formed via an overmoulding process, where the bi-stable elements are moulded in a first mould and then inserted into a second mould prior to the material of the frame element being injected into the second mould. In another embodiment, the frame element is injection moulded in a first step and the bi-stable elements are overmoulded onto the frame element in a second step. In one embodiment, the frame element is injection moulded in a first mould and then transferred into a second mould in which the bi stable elements are overmoulded onto the frame element. In one embodiment, the tray and/or lid is/are injection moulded in a first step and then the bi-stable element(s) is/are overmoulded onto the tray and/or lid.

In one embodiment, the first and/or second bi-stable element(s) extends around the entire periphery of the lid. If the bi-stable element(s) is/are formed as a closed element, then a seal can be formed between the lid and the tray, both in the open and the closed positions.

However, in another embodiment, the first and/or second bi-stable element(s) extend(s) around less than 75%, less than 50% or less than 25% of the periphery of the lid. In one embodiment, the ice cube producing unit could comprise separate bi-stable elements, one arranged on either side of a centre axis of the lid. In one embodiment, the ice cube producing unit comprises four bi-stable elements, two bi-stable elements being arranged on either side of the horizontal centre axis of the lid and two bi-stable elements being arranged on either side of the vertical centre axes of the lid. In one embodiment, the areas between the bi stable elements are filled with a flexible sealing member which is less stiff than the bi-stable elements. In one embodiment, the stiffness of the bi-stable elements at the corners of the tray is less than the stiffness of the bi-stable elements along the sides of the tray. In one embodiment, the thickness of the bi-stable elements at the corners of the tray is less than the thickness of the bi-stable elements along the sides of the tray.

In order to make cleaning easier, in one embodiment, the first and/or second bi-stable element(s) is/are provided with detachable connection means which allow the bi-stable element to be detachably connected to the lid and/or the tray and/or a frame element. In one embodiment, an edge of the bi-stable element is formed with a connection channel which is shaped to engage a side edge of an adjacent element. In one embodiment, the adjacent element is the tray, the lid or a frame element.

In one embodiment, the first and/or second bi-stable element(s) is/are arranged as a sealing element to seal the gap between the lid and the tray both in the open and the closed positions. In one embodiment, the lid and the tray are both formed with an outer peripheral edge which in the open and/or in the closed position are spaced apart from each other to form a gap or a space between the lid and the tray.

It should be clear to the person skilled in the art, that the bi-stable elements could also be connected to other elements which also contribute to the sealing of the gap between the lid and the tray. In one embodiment, the sealing element is in the form of a flexible strip which connects the lid and the tray. In one embodiment, the bi-stable element is a bi-stable elastic element. In one embodiment, the bi-stable element is a flexible element joined to the lid and/or the tray via a hinge element. In one embodiment, the hinge element is a foil hinge element. In one embodiment, the sealing element is made of silicon, rubber, TPE, or another pliable and/or flexible and/or elastic material.

In one embodiment, the lid is also formed as an ice cube tray, the lid and the tray both having at least one ice cube compartment and that in the closed position the lid and the tray are pressed together to define at least one common ice cube compartment and that in the second position, the lid and the tray are separated to allow an ice cube formed in the at least one common ice cube compartment to pass between the lid and the tray. In this way, a symmetrical ice cube can be formed and a symmetrical appearance can be provided to the ice cube producing unit. In one embodiment, the lid and the tray are formed identically. In this way, the lid and the tray can be manufactured via the same tooling.

In one embodiment, in the closed position, the ice cube compartment formed in the lid is arranged opposite the ice cube compartment formed in the tray. In one embodiment, the ice cube compartment in the lid is a mirror image of the ice cube compartment in the tray. In one embodiment, the portion of the lid which defines the at least one ice cube compartment is formed as a mirror image of the portion of the tray which defines the at least one ice cube compartment. In one embodiment, the ice cube compartment in the tray and the cube compartment in the lid form a shared ice cube compartment when in the closed position.

In one embodiment, the first bi-stable element is attached to the lid via a permanent connection along one side edge of the bi-stable element, the second bi-stable element is attached to the tray via a permanent connection along one side edge of the bi-stable element, the first bi-stable element being formed with a releasable connection element along a second side edge of the bi-stable element, said releasable connection element being arranged to detachably connect to one side edge of a frame element and the second bi-stable element being formed with a releaseable connection element along a side edge of the second bi-stable element which is arranged to detachably connect to a second side edge of a frame element. In one embodiment, a bi-stable element is co-injected with the lid and/or the tray. In one embodiment, a bi-stable element is overmoulded onto a portion of the lid and/or the tray.

In one embodiment, the lid and first bi-stable element are formed identically to the tray and second bi-stable element. In this way, the lid+first bi-stable element and the tray+second bi-stable element can be manufactured via the same tooling. The lid+first bi-stable element and the tray+second bi-stable element can then be connected to two opposite side edges of a frame element and/or to themselves.

In one embodiment, the lid and the tray are formed with complementary guide means to ensure that the lid is oriented correctly with regards to the tray in the closed position. In one embodiment, the complementary guide means comprise a protrusion arranged on the tray or on the lid extending in a direction towards the lid or the tray respectively and a corresponding recess arranged on the lid or the tray respectively, said protrusion being arranged to engage with the recess when moving from the open to the closed position. In one embodiment, the protrusion and/or the recess are tapered.

In one embodiment, the ice cube producing unit comprises at least two ice cube compartments and the lid and the tray of the ice cube producing unit are arranged such that in the closed position of the unit, each of said at least two ice cube compartments is individually sealed.

In one such embodiment, the lid and the tray are arranged such that in the closed position of the unit there is a gap between the tray and the lid at the border between at least two adjacent ice cube compartments to allow contents of the ice cube producing unit to move between the at least two ice cube compartments. In one embodiment, the gap has a maximum cross sectional area on a plane which is perpendicular to the plane of the lid which is less than 20%, less than 15%, less than 10% or less than 5% of the maximum cross sectional area of the ice cube compartment along a plane which is perpendicular to the plane of the lid.

In one embodiment, the ice cube producing unit further comprises a handle portion connected to the lid or the tray, said handle portion being arranged to allow a user to apply a force which pulls the lid away from the tray. In one embodiment, the handle portion comprises at least two attachment points to the lid or the tray, said two attachment points being offset from each other along a vector which is parallel to the plane of the lid. In one embodiment, the lid has a length and a width, said length being greater than said width, said vector connecting said attachment points having a major component which is arranged parallel to said length. In one embodiment, said vector connecting said attachment points has a length which is greater than 50% of the length of the lid. In one embodiment, a second handle portion is attached to the tray or the lid respectively. In one embodiment, the side edges of the tray and/or lid are formed with a finger accessible edge whereby the lid and/or the tray can be pulled away from the tray and/or lid.

The above discussion has disclosed a number of embodiments related to a first invention. However, the current specification further comprises additional inventions which could form the basis of one or more divisional applications. Text suitable for drafting claims directed to these extra inventions is provided below. For the sake of brevity, it should be mentioned that many of the features described in relation to the embodiments described above, could also be combined with the inventions described below. We maintain that the person skilled in the art will be able to make the combinations based on the combined teachings of this specification.

A second invention relates to an ice cube producing unit comprising a tray and a lid, said tray being formed as an ice cube tray having at least one ice cube compartment, said ice cube producing unit having a closed position where the lid is connected to the tray along a sealing interface which seals the peripheral area of contact between the ice cube tray and the lid, said sealing interface being arranged such that the stiffness of the sealing interface is lower than the stiffness of the lid and the tray.

In prior art type ice cube trays which are provided with lids, the lid is typically attached to the tray via a stiff connection. For example a rubber lid is provided with a connection channel arranged along its periphery. During mounting of the lid on the tray, this connection channel is pressed into a force fitting arrangement with an edge of the tray. The tray is typically stiff and the connection channel is typically thicker than the material of the lid, whereby the interface between the lid and the tray is rather stiff. During freezing of water stored in the tray, the central portion of the lid will slowly bend outwardly due to the expansion of the ice. This will typically create a large growth in the central portion of the tray. This creates thick ice bridges causing problems with getting the ice cubes out of the tray.

Via this second invention, the concept is that the tray and the lid are relatively stiff and then a less stiff portion is provided between the lid and the tray. When the ice expands, the entire lid will move away from the tray in a uniform manner as the sealing interface deforms instead of the lid or the tray. In this way, a more uniform thickness ice bridge will be provided between adjacent ice cubes. This will make it easier to break these ice bridges and easier to remove the ice cubes from the ice cube tray.

A third invention, relates to an ice cube producing unit comprising a tray formed as an ice cube tray having at least one ice cube compartment, a lid which is suitable for being mounted on the tray to seal contents of the at least one ice cube compartment inside said at least one ice cube compartment, a displacing mechanism connecting the tray and the lid and having two positions: a closed position where the lid is held in a position where it abuts the tray and an open position where the lid is held in a position where it is separated from the tray so that an ice cube formed in the tray can leave the tray characterized in that said ice cube producing unit comprises a resealable opening, said resealable opening having a minimum area which is greater than the maximum cross sectional area of the ice cube compartment along a plane which is perpendicular to the lid when the displacing mechanism is in its closed position such that an ice cube released from the ice cube compartment can exit through the resealable opening.

In one embodiment, the dimension from the outer surface of the lid to the outer surface of the tray, perpendicular to the plane of the lid in the closed position of the displacement mechanism is less than the dimension of the open area of the resealable opening along a vector which is perpendicular to the plane of the lid. In this way, the unit can have a reduced cross sectional thickness, without loosing the ability to allow ice cubes to leave the unit in the open position.

In one embodiment, in the closed position of the displacing mechanism, the outer surface of the tray is formed complementary to the outer surface of the lid. In this way, it is possible to stack units on top of each other in an easy manner.

In one embodiment, the resealable opening is arranged along one side of the lid and has cross sectional area arranged on a plane forming an angle to the plane of the lid which is greater than 60 degrees, preferably 90 degrees. In one embodiment, the resealable opening is provided in a frame element which is arranged between the lid and the tray. In one embodiment, the resealable opening is arranged to encircle the lid and the tray. In one embodiment, the frame element is arranged to encircle the periphery of the lid and the tray. In one embodiment, the periphery of the frame element is arranged complementary to the periphery of the lid and/or the tray.

In one embodiment, the resealable opening is circular and has a diameter which is greater than the maximum distance from the inside surface of the tray to the inside surface of the lid along a vector which is perpendicular to the plane of the lid in the closed position of the displacing mechanism. In one embodiment the resealable opening has a diameter which is smaller than or equal to the minimum distance from the inside surface of the tray to the inside surface of the lid along a vector which is perpendicular to the plane of the lid in the open position of the displacing mechanism.

A fourth invention relates to an ice cube producing unit comprising a tray formed as an ice cube tray having at least one ice cube compartment, a lid which is suitable for being mounted on the tray to seal contents of the at least one ice cube compartment inside said at least one ice cube compartment, a displacing mechanism connecting the tray and the lid and having two positions: a closed position where the lid is held in a position where it abuts the tray and an open position where the lid is held in a position where it is separated from the tray so that an ice cube formed in the tray can leave the tray characterized in that the lid is formed as an ice cube tray comprising at least one ice cube compartment which is formed complementary to the at least one ice cube compartment of the tray.

A fifth invention relates to an ice cube producing unit comprising a tray formed as an ice cube tray having at least one ice cube compartment, a lid which is suitable for being mounted on the tray to seal contents of the at least one ice cube compartment inside said at least one ice cube compartment, a displacing mechanism connecting the tray and the lid and having two positions: a closed position where the lid is held in a position where it abuts the tray and an open position where the lid is held in a position where it is separated from the tray so that an ice cube formed in the tray can leave the tray characterized in that the ice cube producing unit further comprises a flexible sealing element which seals the gap between the lid and the tray in both the open and closed positions and further comprises a resealable opening to allow ice cubes formed in the ice cube producing unit to leave the ice cube producing unit via the resealable opening.

In this specification, the lid is held in place in both the open and the closed positions. According to the current specification this should be understood such that the unit itself holds the lid in the specified position. It is not necessary for a user to manually hold the lid in the specified position.

It should be noted that in some of the claims and in parts of the description where two or more ice cube compartments are described, the phrase "individually sealed" is used to describe how the ice cube compartments are sealed. According to this specification this should be understood as meaning that one ice cube compartment should be individually sealed with respect to an adjacent ice cube compartment. The lid should therefore seal up against a divider between adjacent ice cube compartments. It should however, be noted that air/water channels located in the divider to allow water flow between adjacent ice cube compartments should be allowed. The limitation should be in that when the ice cube tray is sealed by the lid, the ice cube tray can be arranged in any position in a freezer without enough ice forming in the area between adjacent ice cubes which would make it difficult to break adjacent ice cubes away from each other in the unit in a controlled manner.

While the person skilled in the art should understand this definition, some more precise definitions are provided here which might be used if necessary. One definition is that the total cross sectional area of the air/water channels in the divider should be less than 20%, less than 15%, less than 10% or less than 5% of the total surface area of the divider of the ice cube compartment in which the air/water channels are located. Furthermore, it should be noted that in certain cases a single large channel is formed in the divider between adjacent ice cube compartments while in other cases, two or more separate air or water channels could be arranged in the divider between adjacent ice cube compartments.

It should be emphasized that the term "comprises/comprising/comprised of" when used in this specification is taken to specify the presence of stated features, integers, steps or components but does not preclude the presence or addition of one or more other features, integers, steps, components or groups thereof.

It should also be noted that where the claims and/or the description refer to an orientation, for example vertical or horizontal, the orientation of the unit shown in FIGS. 1 and 2 should be used to understand the meaning.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

FIG. 12 also shows ice cubes in cross section.

DETAILED DESCRIPTION OF THE EMBODIMENTS

Figure 1:
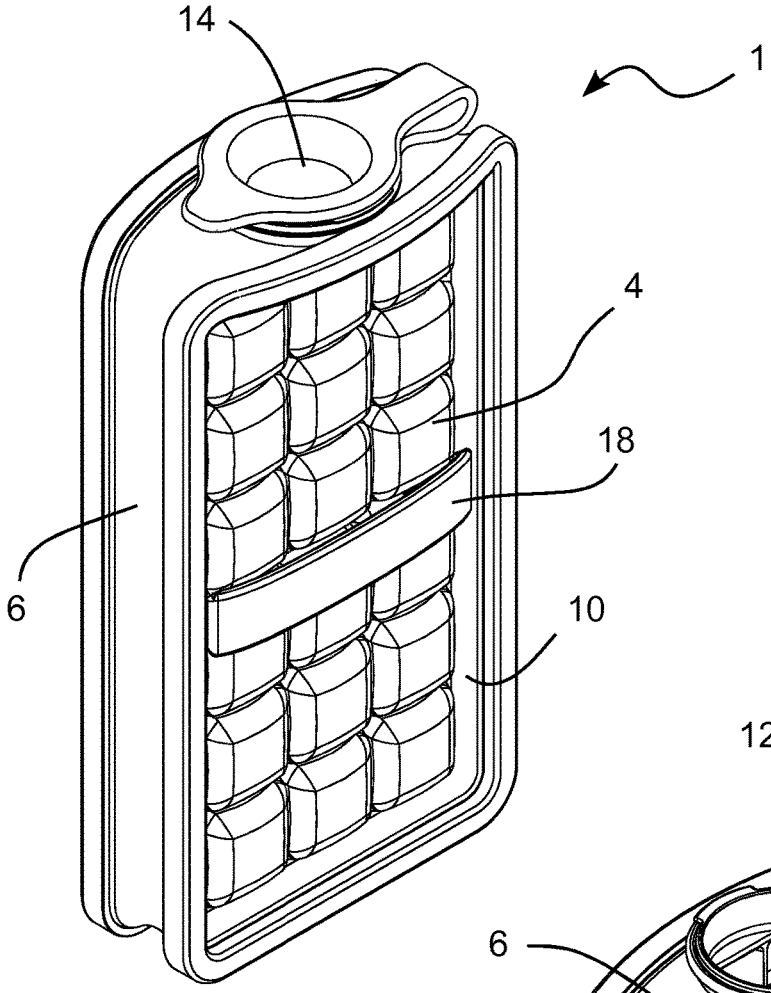
FIG. 1 shows a perspective first embodiment of an ice cube producing unit according to the current invention in a closed position.
Figure 2:
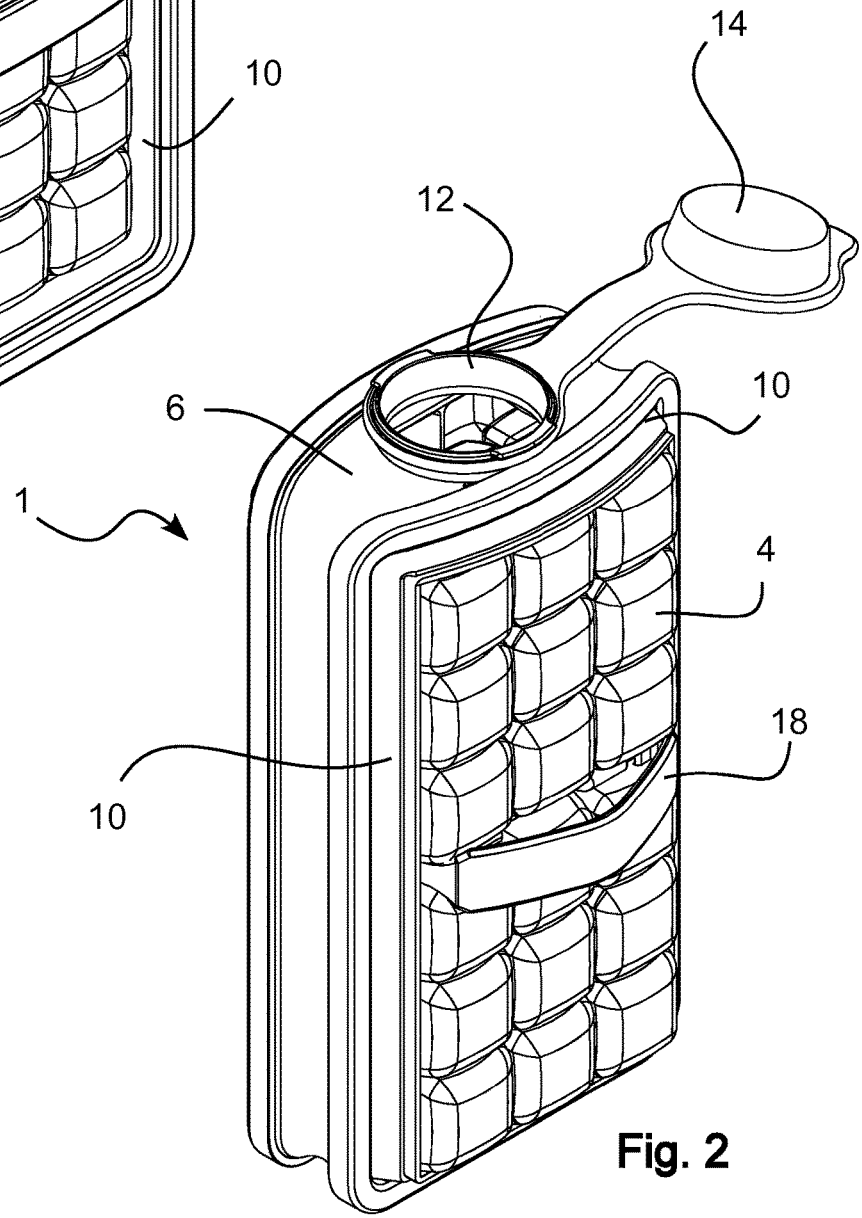
FIG. 2 shows a perspective view of the ice cube producing unit of FIG. 1 in an open position.
Figure 3:
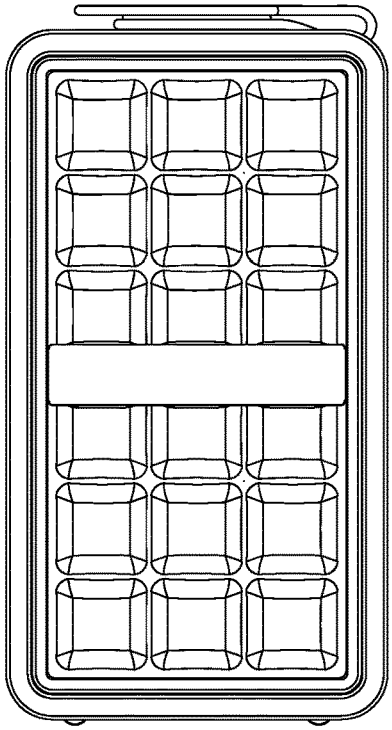
FIGS. 3, 5, 7 and 9 show front, top, bottom and side views of the ice cube producing unit of FIG. 1 in a closed position. It should be noted that front and rear views are the same and that left and right side views are the same, hence only a front and one side view have been shown here.
Figure 4:
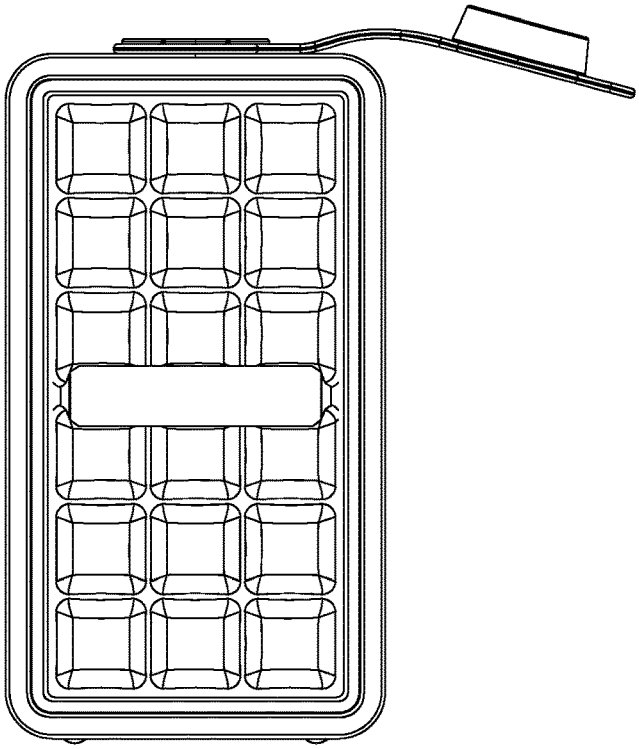
FIGS. 4, 6, 8 and 10 show front, top, bottom and side views of the ice cube producing unit of FIG. 1 in an open position. It should be noted that front and rear views are the same and that left and right side views are the same, hence only a front and one side view have been shown here.
Figure 5:
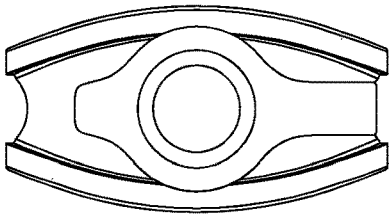
Figure 6:
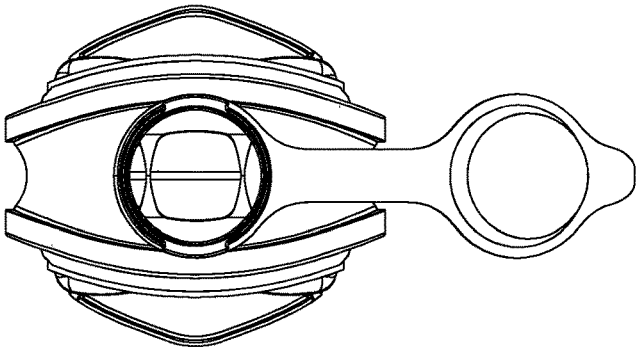
Figure 7:
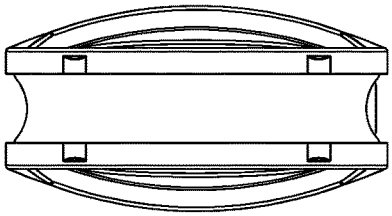
Figure 8:
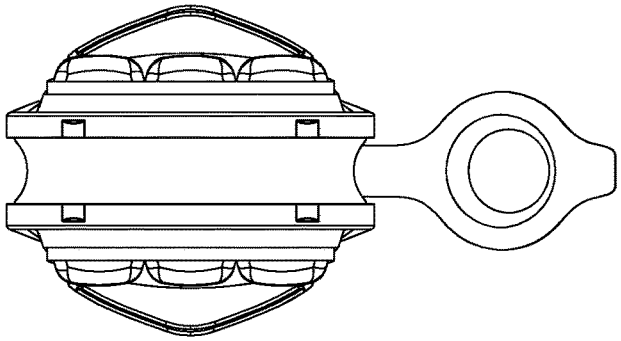
Figure 9:
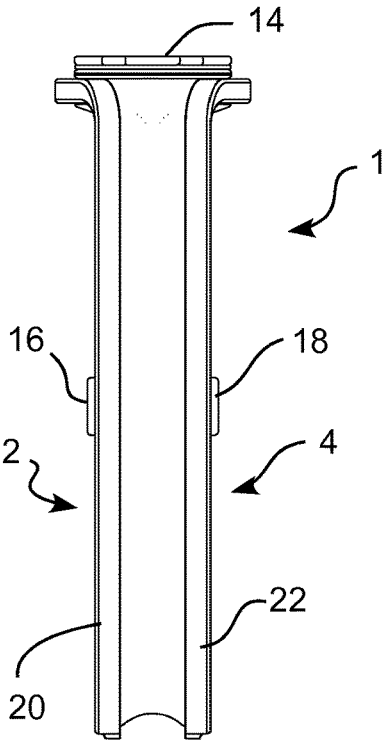
Figure 10:
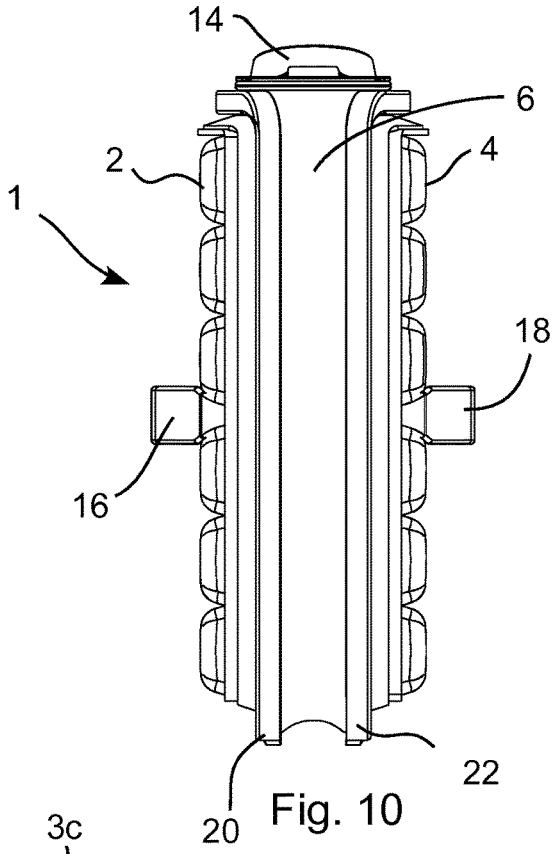

The ice cube producing unit 1, shown in FIGS. 1-15 is a first embodiment of an ice cube producing unit according to the current invention. It should be noted that the unit shown in the figures is an early prototype and changes can be expected in a final unit which is ready for production.

The unit 1 comprises a first ice cube tray 2 (hidden in FIGS. 1+2) and a second ice cube tray 4. Each ice cube tray is formed with a number of ice cube compartments 3*a*, 3*b*, 3*c*, 5*a*, 5*b*, 5*c* separated by horizontal and vertical dividing walls 7,9. In the example embodiment 1 shown in FIGS. 1-15, each ice cube tray has 18 ice cube compartments 3,5.

The two ice cube trays are formed as mirror images of each other and when the two trays 2,4 are pressed together, they form a number of common ice cube compartments 3*a*+5*a*, 3*b*+5*b*, 3*c*+5*c*. In the example embodiment of FIGS. 1-15, there are a total of 18 common ice cube compartments, which means that 18 ice cubes are formed. It can be seen that the actual ice cubes 13 formed by the unit showing in FIGS. 1-15, are formed in the common ice cube compartments formed between the two trays. Hence, each ice cube compartment of each tray, forms half of an ice cube 13 of the unit.

In the terminology of the claims of the current specification, one of the trays is considered a lid and the other is considered a tray in order to achieve a broader scope of protection. It should be clear to the person skilled in the art, that a construction could be imagined with a single ice cube tray and a simple lid, where the lid is formed as an essentially planar element and the ice cube compartments are arranged in the tray alone.

The unit further comprises a frame element 6 and two bi-stable elements 8,10. In respect to the claims, the combination of the frame element and the two bi-stable elements can be considered to be a displacing mechanism. In this embodiment, there are two bi-stable elements working together. However, it should be clear to the person skilled in the art that in another embodiment (not shown) a unit could be imagined with a single tray, a simple lid and a single bi-stable element arranged between the lid and the tray to form a displacing mechanism.

In one end of the frame element 6, an opening 12 is formed which can be closed by a closure element 14. The frame element is formed asymmetrically around its horizontal axis such that the upper portion which comprises the opening is considerably wider than the bottom portion. In this way, the total volume enclosed by the unit in the closed position is reduced, while still allowing rather large ice cubes to leave the unit when in the open position.

The unit also comprises two handle elements 16,18. A first handle element 16 is connected to the first tray 2 and a second handle element connected to the second tray 4. In the current embodiment, the handle portion is connected to either side of the trays along the short dimension of the trays. However, in another embodiment (not shown), the handle portion could be connected along the long dimension of the tray. For example, when looking at FIGS. 1 and 2, the handle element could be connected to the middle column of the ice cube trays and to the second from the top and the second from the bottom row of the ice cube trays. In this way, it is easier to pull out the top and bottom of the trays when frozen. The placement of the handle portion can be optimized based on the design of the bi-stable elements. For example, if the bi-stable elements are stiffest along the vertical sides of the unit, then placing the handle as shown in the figures could be a good solution. However, if the bi-stable elements are uniform along the entire periphery, then the vertical placement as described above, could be more advantageous. It is also clear, that the stiffness of the bi-stable elements around the periphery can also be tuned to work well with the handle placement.

As can be seen by comparing FIGS. 1,3,5,7,9,11 with corresponding FIGS. 2,4,6,8,10,12, the unit has two positions, a closed position shown in FIGS. 1,3,5,7,9,11 and an open position shown in FIGS. 2,4,6,8,10,12. In the closed position, the two trays are pressed in against each other to form individual ice cube compartments 3*a*+5*a*, 3*b*+5*b*, 3*c*+5*c* between the two trays. In the open position, the two trays are pulled apart to allow the ice cubes 13 formed in the ice cube compartments to fall out of the trays. As can be seen especially well in FIGS. 11 and 12, in the open position, the minimum distance D1 between the two trays is greater than the maximum dimension D2 of the ice cubes. This ensures that when the trays are pulled apart, the ice cubes 13, with a maximum dimension D2, can easily pass between the two trays to fall out through the opening when the unit is opened and shaken. In another embodiment (not shown), the dimension D1, can be made just slightly larger than the dimension D3 from the inside surface of the first tray 2 to the inside surface of the second tray 4 along a vector which is perpendicular to the plane of the first tray 2. In this case, if the ice cubes rotate slightly in the unit during exit, they will bind, but eventually and with enough shaking they will come out. The optimal expansion between the open and closed positions will be a compromise between allowing the ice cubes to easily fall out, and reducing the size as much as possible.

Figure 11:
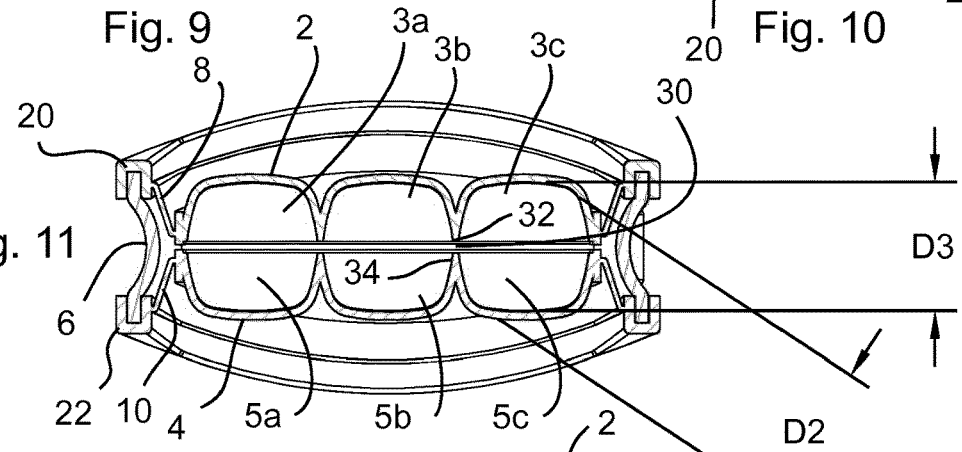
FIG. 11 shows a cross section through the ice cube producing unit of FIG. 1 in its closed position.
Figure 12:
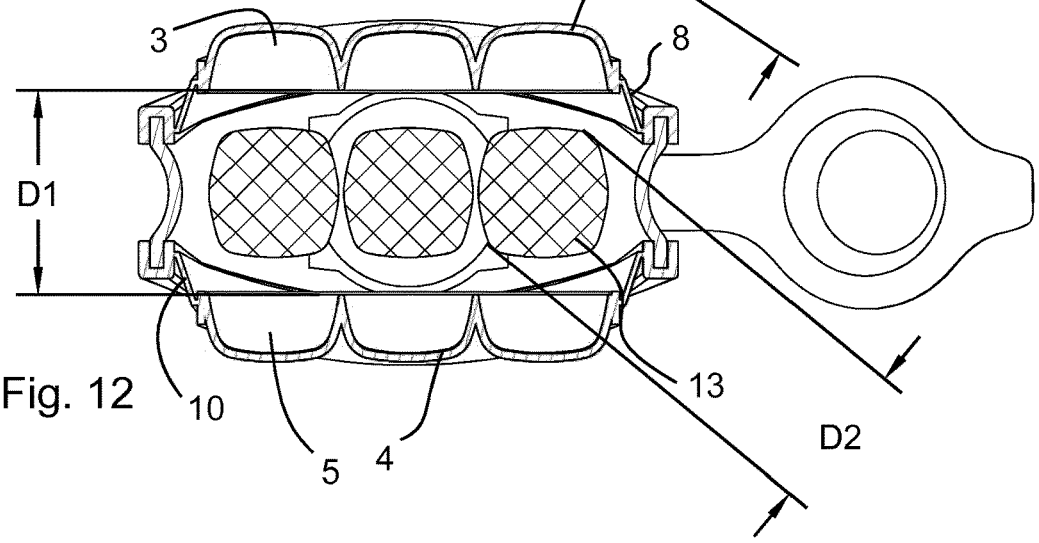
FIG. 12 shows a cross section through the ice cube producing unit of FIG. 1 in the open position.
Figure 13:
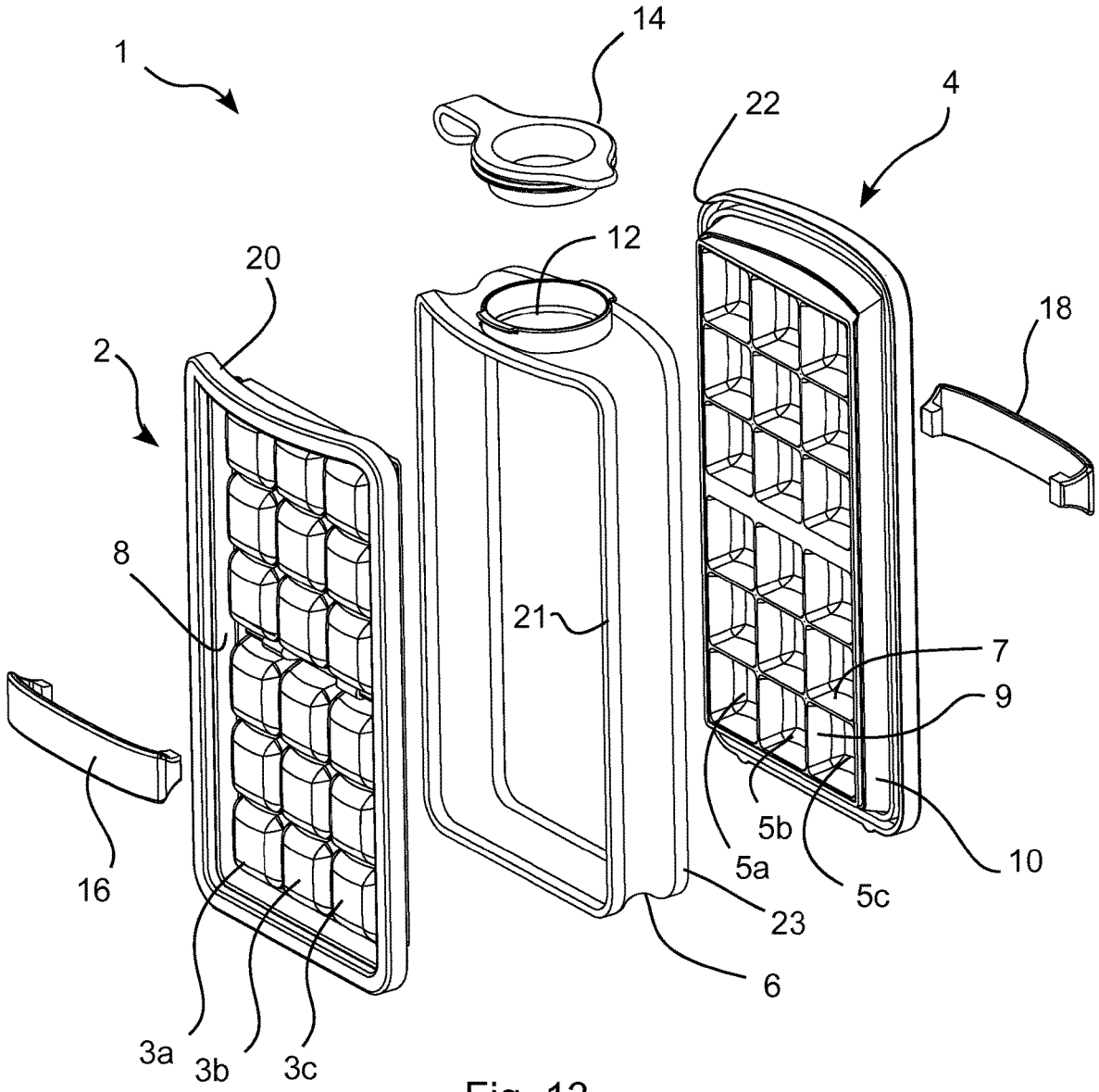
FIG. 13 shows a perspective exploded view of the ice cube producing unit of FIG. 1 in a closed position.

From FIG. 11, it can be seen that in the closed position, the lid and the tray have a small gap 30 between the border 32 of the lid and the border 34 of the tray. In this way, water and air can flow between the lid and the tray during filling to spread the water or other liquid between the lid and the tray.

In the current invention, the frame element 6, and the trays 2, 4 are all made of an injection moulded plastic material (in one example PP) which has a certain stiffness to ensure the structural integrity of the unit. However, the stiffness is also chosen to allow the unit to be twisted slightly by a normal human user. This allows the ice bridges connecting adjacent ice cubes to be broken in a controlled manner and to allow the ice cubes to be released from the trays when it is desired to remove the ice cubes from the unit. If the unit is too stiff, then it will be difficult to twist the unit. It is currently believed that a certain amount of flexibility needs to be incorporated into the design to allow the user to twist the unit to free the ice cubes and break that ice bridges.

The bi-stable elements 8,10 are formed as TPE strips which join the trays to the frame element. In the current embodiment, the bi-stable elements are formed from a TPE with shore hardness of 50. However, other shore hardnesses could also be imagined. By making the bi-stable element thicker, a softer shore hardness could be used. By making the bi-stable element thinner, a harder shore hardness could be used. By optimizing the cross sectional thickness and form of the bi-stable elements at different locations around the periphery, different shore hardnesses could be used.

A releasable connecting portion 20, 22 is formed along one edge of the bi-stable elements to allow the bi-stable elements 8,10 to releasably connect to the side edges 21,23 of the frame element 6. The bi-stable elements are in this embodiment permanently connected to the periphery of the trays. In this example, the bi-stable elements are overmoulded onto the trays in a two stage moulding operation. The tray is injection moulded in a first moulding operation and then the tray is inserted into a second mould after which the material of the bi-stable elements is injected into the second mould such that the material of the bi-stable elements over moulds onto the material of the trays. However other forms of manufacturing technique could also be used.

In one embodiment, the connecting portion could also be injection moulded from a stiffer plastic material, for example PP. In this case, the connecting portion and the tray can be injection moulded in a first operation and then inserted into a mould after which the bi-stable element is overmoulded onto both the connecting portion and the tray.

The fact that the trays can be removed from the frame element allows the unit to be opened up and cleaned in an easy manner. However, it could also be imagined that a lower cost embodiment could be manufactured where the bi-stable elements, the ice cube trays and the frame element were all permanently connected. In this case, it would be more difficult to clean the inside of the unit, but the price and complexity could also decrease. This could therefore allow the manufacture of a disposable unit, where the unit could be used a certain number of times, after which it could be disposed. In one embodiment, the different elements could be permanently glued together. For example, the bi-stable elements could be glued to a frame element. Detachable gripping portions as shown in the figures which are strong enough to hold the unit together during normal use while still allowing for easy disassembly will need to be made a certain strength and design. This could increase the material costs and manufacturing complexity. Gluing the elements together might be a simpler manufacturing operation. In another example, the frame element could be designed as two separate elements which are glued together after moulding.

Figure 14:
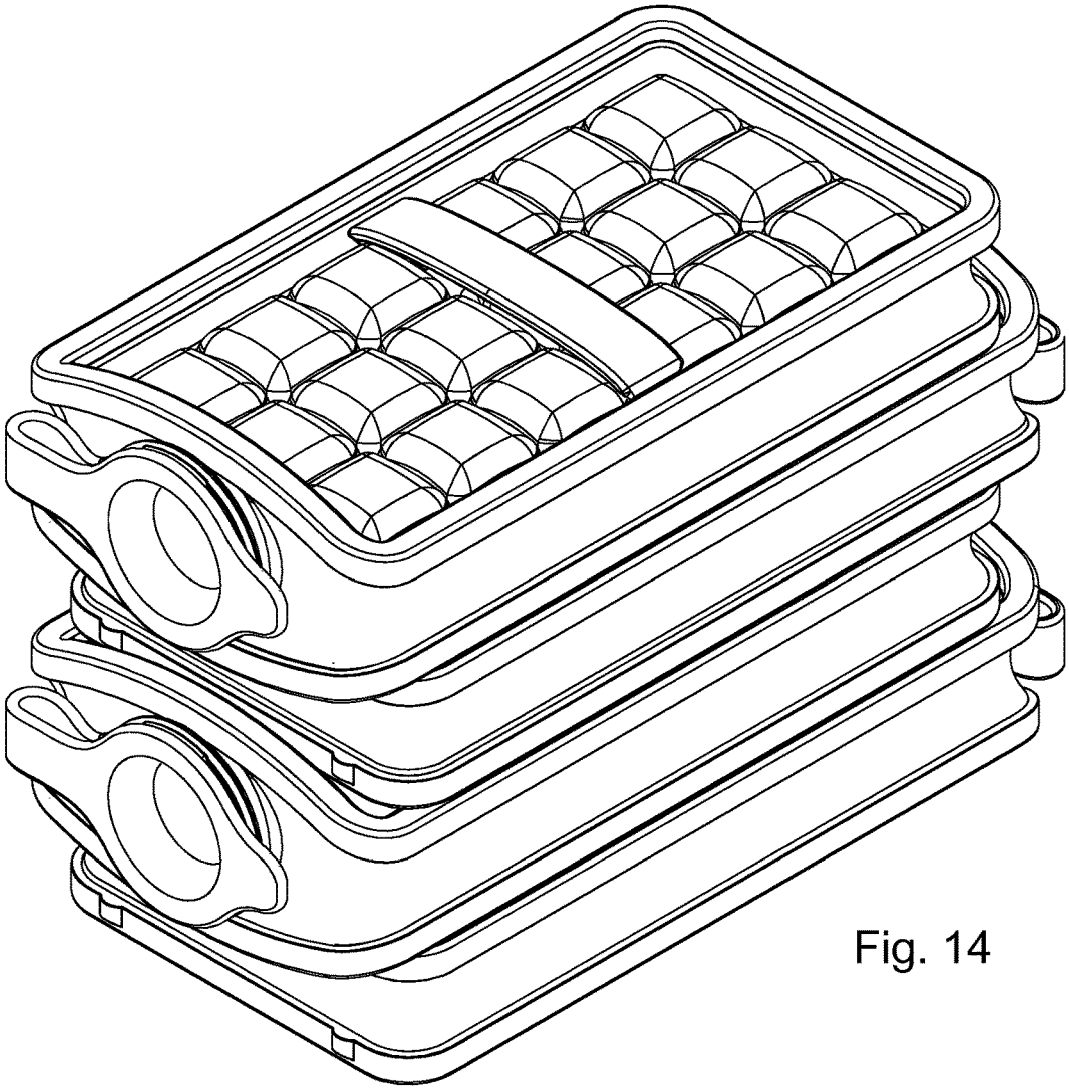
FIG. 14 shows a perspective view of four ice cube producing units as shown in FIG. 1, stacked on top of each other.
Figure 15:
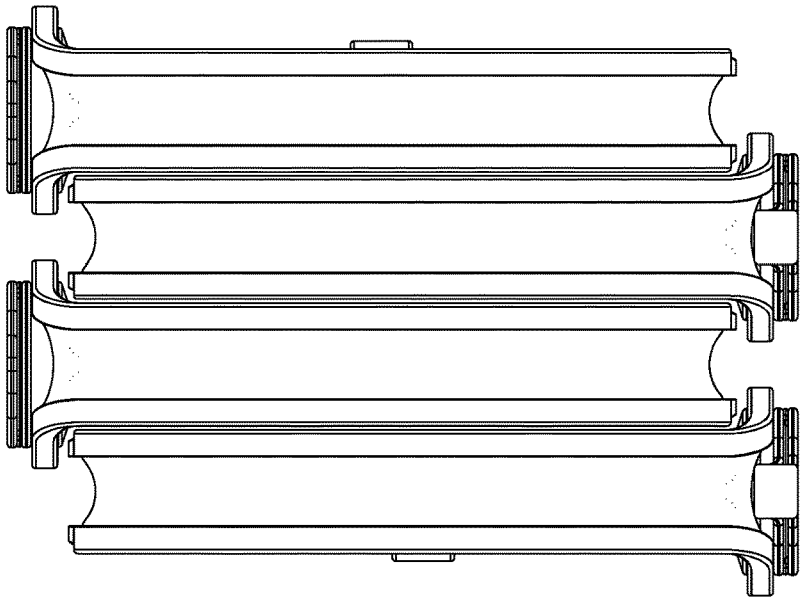
FIG. 15 shows a side view of the stack of four ice cube producing units as shown in FIG. 14.

From FIGS. 14 and 15, it can be seen that the units are arranged to allow stacking of the units on top of each other. This is useful when storing in a freezer. In order to reduce the stacking height of the units, the units are formed with an opening arranged at one side which is larger than the thickness of the units when in the closed position. In this way, the stacking height is kept to a minimum while still allowing larger sized ice cubes to leave out through the opening. Due to the asymmetric arrangement of the opening, the units are stacked in alternating directions. Furthermore, as can be seen from FIGS. 14 and 15, the outer surfaces of the ice cube trays 2,4 are formed complementary to each other in the closed position of the units to allow efficient stacking.

In the embodiment shown in FIGS. 1-15, the outer surfaces of the ice cube trays are formed to visually show the shape of the ice cubes. However, it is clear to the person skilled in the art, that the outer surfaces could be formed in many different ways. In one embodiment, the outer surface is filled out so that it is planar. In this case, the unit will have flat sides which will look visually attractive. In one embodiment, a planar sheet is mounted on the outer surface of the ice cube trays and which is formed complementary to the outer surface of the gripping elements 20,22. In this way, the planar sheet forms a form of cover element which covers the trays. The planar sheet could be provided with finger openings, to allow the trays to be pulled apart.

Figure 16:
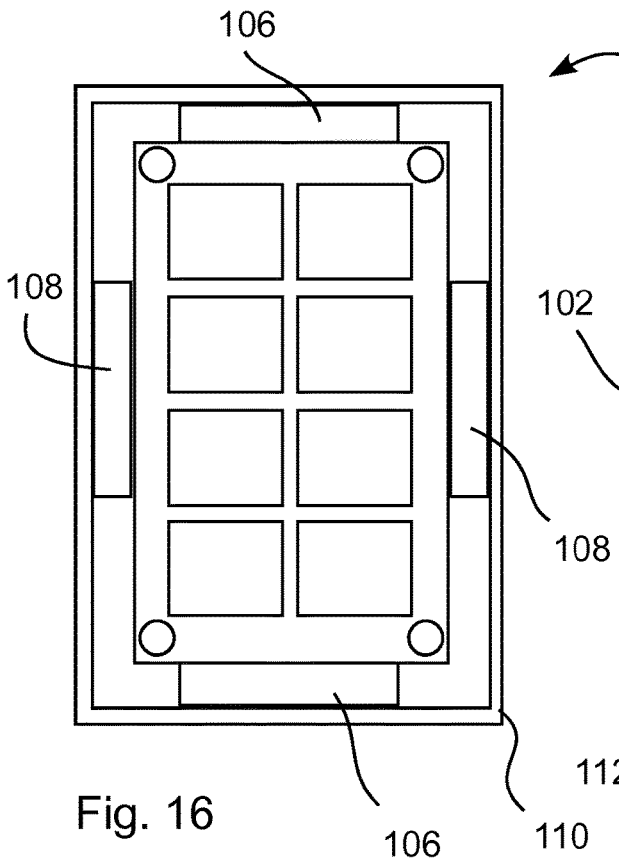
FIG. 16 shows a very schematically drawn front view of a second embodiment of an ice cube producing unit according to the invention.
Figure 17:
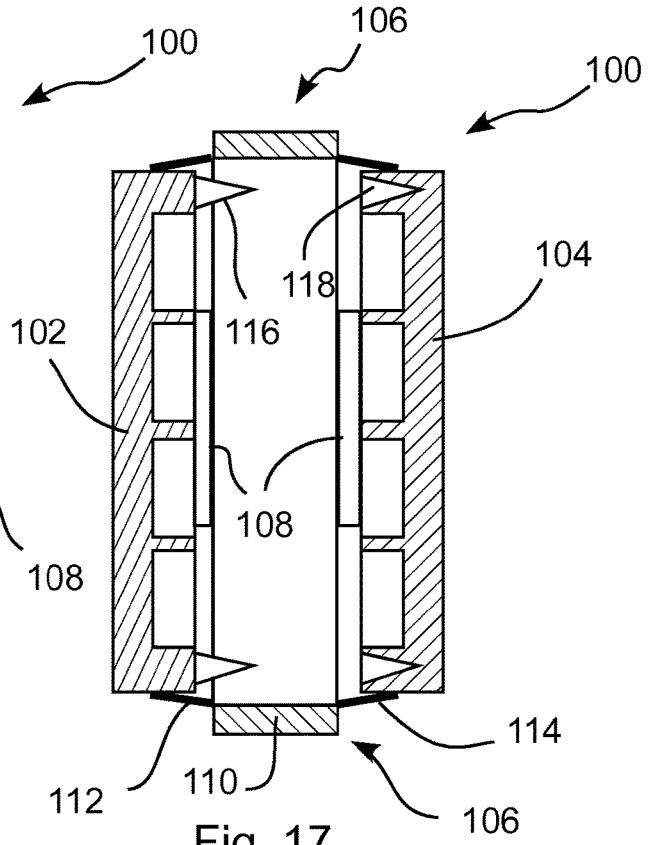
FIG. 17 shows a side view of the second embodiment of an ice cube producing unit shown in FIG. 16 in an open position.
Figure 18:
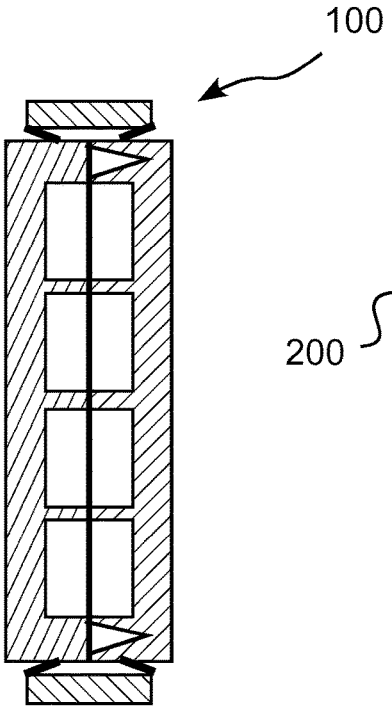
FIG. 18 shows a side view of the second embodiment of an ice cube producing unit shown in FIG. 16, in a closed position.

FIGS. 16-18 shows some different schematic views of a second embodiment of an ice cube producing unit according to some aspects of the current invention. In this embodiment, the unit 100 comprises a first tray 102 and a second tray 104 formed as a mirror image of the first tray. The two trays are held apart from each other in the open position of the unit as shown in FIGS. 16 and 17 by two bi-stable elements 106 mounted to the top and bottom of the trays and two bi-stable elements 108 mounted to the sides of the trays. In this example, the bi-stable elements do not extend all the way around the periphery of the unit, but are only arranged at the top and bottom and sides of the unit. A frame element 110 again extends around the entire periphery of the unit to provide stiffness to the structure and to provide support for the bi-stable elements. As in the previous embodiment, an opening is formed in the rim portion to allow the ice cubes to exit the unit. In the terminology of the claims, the frame element with the bi-stable elements can be considered as a displacing mechanism. The bi-stable elements again comprises bi-stable strips 112, 114. In this example, since the bi-stable strips do not extend all the way around the periphery, it is possible to assembly the unit instead of co-injecting or co-moulding the different elements directly together. For example a groove could be formed on the edges of the trays in to which an edge of the bi-stable element could be inserted.

In this example, since the bi-stable elements do not extend around the entire periphery of the unit, the unit is not entirely sealed in the closed position or in the open position. In another embodiment, not shown, a separate container could be arranged around the entire structure, for example, an elastic bag like structure could be provided which seals the contents of the unit inside the plastic bag. The plastic bag could be arranged as an elastic material which pressed tightly around the unit when closed and stretches when opened.

In order to ensure that the two trays join properly together, in the closed position, the two trays are provided with guiding elements in the form of tapered protrusions 116 on one tray and tapered recesses 118 on the other tray. When the trays are pressed towards each other, the protrusions engage with the recesses and ensure properly alignment. This is just one simple embodiment of guiding means and other options could be imagined by the person skilled in the art. For example a pin and slot arrangement could be provided.

In the above disclosed embodiments, the opening for filling the unit and for emptying the unit is provided in the frame element of the unit. This is a good position for both filling and emptying. However, by placing it in the end, the thickness at the end needs to be increased to allow the ice cubes to leave the unit. This makes an asymmetric construction necessary, or results in wasted space. Another option is to put a small filling opening in an upper portion of the frame element and an emptying opening in the body of the tray. In this case, one of the ice cube compartments in one of the trays could be replaced with a resealable opening.

Figure 19:
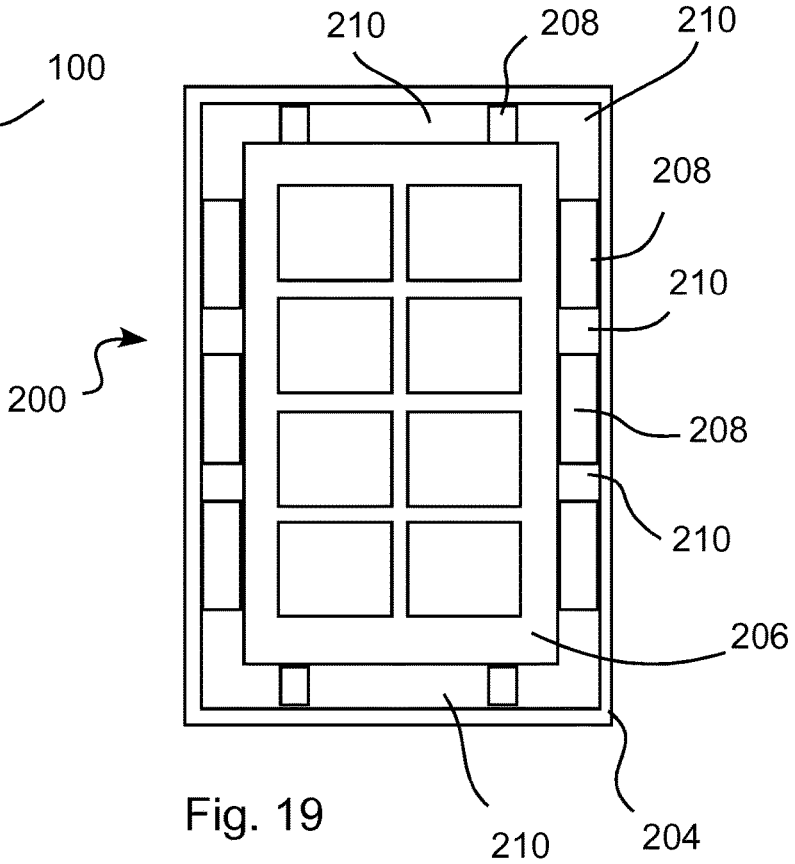
FIG. 19 shows a very schematically drawn front view of a third embodiment of an ice cube producing unit according to the invention.

In FIG. 19, a third embodiment 200 of an ice cube producing unit according to the current invention is disclosed. In this case, a flexible plastic strip element 202 formed as a bi-stable element is arranged around the entire periphery of the lid and the tray, as with the embodiment of FIGS. 1-15. Furthermore, as with FIGS. 1-15, the unit 200 also comprises a frame element 204. In this way, the gap between the lid 206 and the tray is completely sealed by the bi-stable element 202 and the frame element 204. However, instead of having a uniform thickness, the strip 202 is arranged with differing thicknesses along the periphery of the lid 206. In the sections marked with 208, the thickness of the strip is greater than the sections marked with 210. In this way, the thicker sections 208 are stiffer and more resistant to deformation than the thinner sections 210. The thicker sections 208 will provide a strong bi-stable effect while the thinner sections 210 will provide less of a bi-stable effect, while still providing a sealing effect. Especially by reducing the stiffness at the corners, the motion of the trays can be effected.

Figure 20:
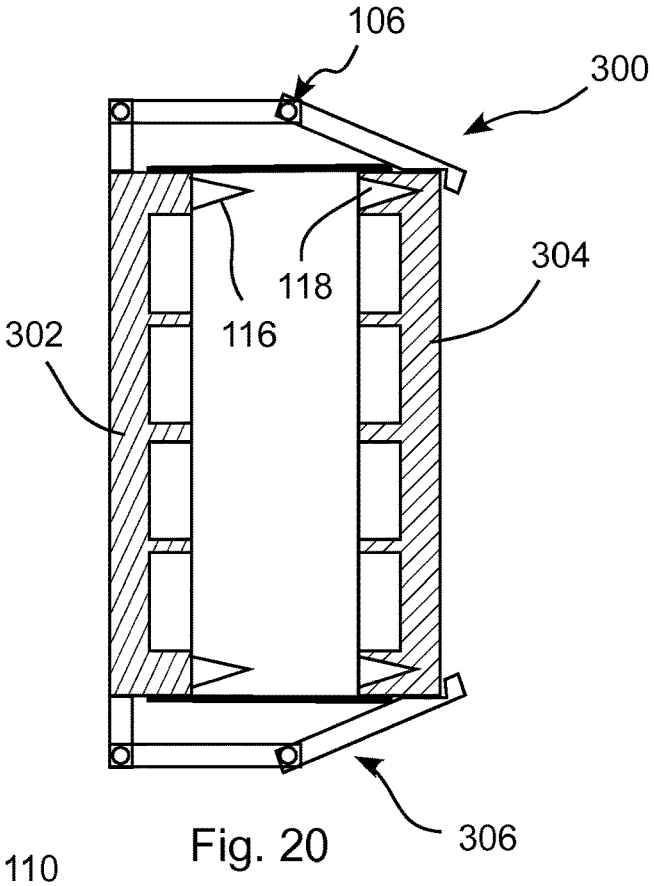
FIG. 20 shows a very schematically drawn cross sectional side view of another example of an ice cube producing unit in an open position.
Figure 21:
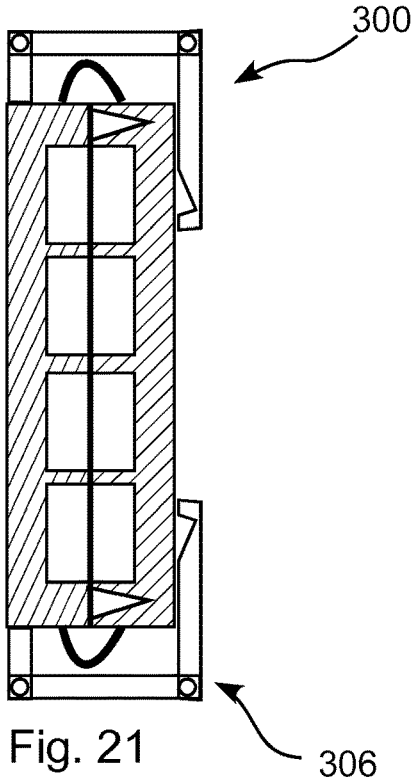
FIG. 21 shows the ice cube producing unit of FIG. 20 in an closed position.

In FIGS. 20 and 21 a fourth example 300 of an ice cube producing unit is shown. This example is not covered by the current claims 1-10, but is an example of one of the other inventions disclosed in this specification. In this case, there is no bi-stable element holding the two trays 302, 304 away from each other in the open position or together in the closed position. Rather, a linkage mechanism 306 is used to hold the trays together in the closed position (FIG. 21) and away from each other in the open position (FIG. 20). The linkage 306 is shown very schematically, however, it is maintained that the person skilled in the art could provide a mechanism which would work.

An elastic sealing element 308 is provided between the two trays. In the open position, the elastic sealing element is stretched and in the closed position, the elastic sealing element is pulled together and is loose. Depending on the material used for the sealing element, it could be imagined that the sealing element is slightly stretched in the closed position and more stretched in the open position. This would provide a more uniform appearance.

In this embodiment 300, instead of using a bi-stable element as both the displacing mechanism and a sealing mechanism as in the embodiment of FIGS. 1-15, in this embodiment, the sealing effect and the displacing effect are separated into two separate elements, a sealing element 308 and a displacing mechanism 306.

Figure 22:
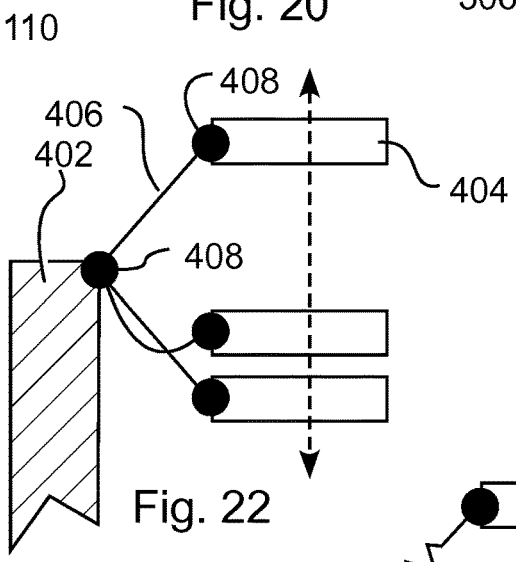
FIG. 22 shows a schematic example of a first example of a displacing mechanism comprising a bi-stable element.

FIG. 22 shows an example 400 of a displacing mechanism comprising a bi-stable element. This example is similar to the construction of the bi-stable elements of FIGS. 1-15. The mechanism comprises a portion of a frame element 402, a portion of a tray 404 and a bi-stable element 406. The bi-stable element is in the form of a bendable plastic strip. The bendable plastic strip is connected to the frame element and the tray via a hinge element 408. When the tray is in the upper position, the bi-stable element is stable and the tray is held in this position. When the tray is pushed downwards as shown by the middle position, then the bi-stable element is deformed and force is required to push it into this position. When the bi-stable element released, it will try to move into a stable position. If the tray has been pushed far enough down, then the bi-stable element will try to get into the lower position. If the tray has not been pushed far enough down, then the bi-stable element will try to get into the upper position. In either case, when the tray is in the upper or lower position, it holds its position stably and force is required to displace it from its position.

It can be noted that in the example of FIG. 22, the tray is constrained to move up and down and not side to side. This is an important feature for some bi-stable elements. In the example of FIG. 22, if the tray were free to move sideways, then the bi-stable effect would not be present. Hence, in certain types of bi-stable mechanism, similar to the one of FIG. 22 (and FIG. 23 and FIG. 24), it is necessary to constrain the trays from moving side to side. One way of doing this is to arrange the bi-stable element around the entire periphery of the tray and lid. Another way of doing this is to have some form of guidance mechanism which controls the motion of the trays with respect to each other. Another way of doing this is to arrange bi-stable elements at the sides of the trays and then a hinge member at the top and bottom of the trays to prevent sideways motion.

Figure 23:
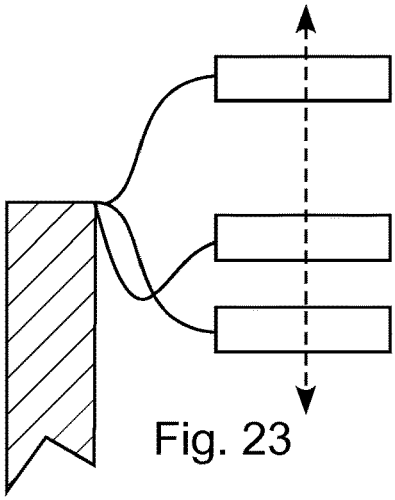
FIG. 23 shows a schematic example of a second example of a displacing mechanism comprising a bi-stable element.

FIG. 23 shows another schematic example where instead of two hinges, the bi-stable element itself is formed with bendable ends or as a uniform bending structure which deforms when moving from the upper to the lower position.

Figure 24:
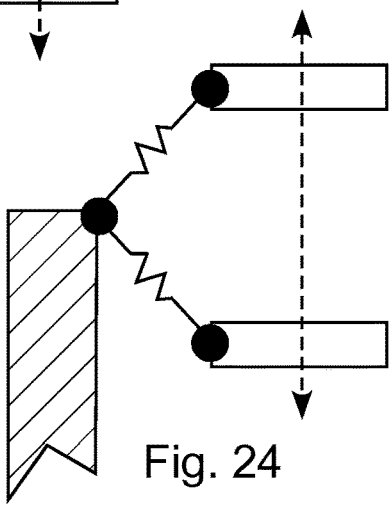
FIG. 24 shows a schematic example of a third example of a displacing mechanism comprising a bi-stable element.

FIG. 24 shows another schematic example where instead of a bendable element, the bi-stable element is in the form of a spring which is compressed during the motion from the upper to the lower position.

Other forms of bi-stable elements can also be imagined.

In FIGS. 22-24, the motion of the tray upwards and downwards is identical about the connection point to the frame element. However, in other cases, the bi-stable element could be arranged to allow the tray to move more upwardly than downwardly. In other cases, the ice cube producing unit could be arranged such that when the unit is in the closed position, the lid and the trays abut each other, without allowing the bi-stable elements to completely reach a stable position. In this case, the bi-stable elements can provide a force which presses the lid and the tray together. This can be used to increase the sealing ability of the interface between the lid and the tray.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific production techniques have not been described in detail since it is maintained that the person skilled in the art would be able to find suitable materials and suitable processes to manufacture the container according to the current invention.

The invention claimed is:

1. An ice cube producing unit comprising:

a frame including a first edge surrounding a first aperture, a second edge surrounding a second aperture, a rim extending between the first edge and the second edge, and an opening located on a portion of the rim, wherein the opening is configured to receive a closure element;

a first tray including a first plurality of compartments, wherein the first plurality of compartments have an interior-facing border and an exterior side;

a second tray including a second plurality of compartments, wherein the second plurality of compartments have an interior-facing border and an exterior side;

a first bi-stable element located between the first edge of the frame and the interior-facing border of the first tray;

a second bi-stable element located between the second edge of the frame and the interior-facing border of the second tray; and a first handle secured to the exterior side of the first plurality of compartments;

wherein the first bi-stable element secures the first tray to the first edge of the frame and the second bi-stable element secures the second tray to the second edge of the frame, and wherein at a first state, a distance between the interior-facing border of the first plurality of compartments and the interior-facing border of the second plurality of compartments has a first width, and at a second state, the distance between the interior-facing border of the first plurality of compartments and the interior-facing border of the second plurality of compartments has a second width, wherein the second width is greater than the first width.

2. The ice cube producing unit of claim 1, further comprising a first releasable connecting portion arranged between the frame and the first tray.

3. The ice cube producing unit of claim 2, further comprising a second releasable connecting portion arranged between the frame and the second tray.

4. The ice cube producing unit of claim 1, wherein the frame includes a first portion having a first width and a second portion having a second width, wherein the first width is larger than the second width.

5. The ice cube producing unit of claim 1, wherein the rim includes a first pair of sidewalls having a first length and a second pair of sidewalls having a second length, wherein the first length is larger than the second length.

6. The ice cube producing unit of claim 5, wherein the opening is located within one sidewall of the second pair of sidewalls.

7. The ice cube producing unit of claim 1, further comprising a second handle secured to the exterior side of the second plurality of compartments.

8. The ice cube producing unit of claim 1, wherein each compartment of the first plurality of compartments corresponds to a compartment of the second plurality of compartments to form a plurality of ice cube compartments.

9. The ice cube producing unit of claim 8, wherein the plurality of ice cube compartments includes at least 18 ice cube compartments.

10. The ice cube producing unit of claim 1, wherein the first tray includes a first set of walls forming the first plurality of compartments and the second tray includes a second set of walls forming the second plurality of compartments.

11. The ice cube producing unit of claim 1, wherein the first bi-stable element and the second bi-stable element each include a thermoplastic polyurethane elastomer.

12. The ice cube producing unit of claim 1, wherein the first tray is removably attached to the first edge of the frame.

13. The ice cube producing unit of claim 12, wherein the second tray is removably attached to the second edge of the frame.

14. The ice cube producing unit of claim 1, wherein at the first state, the ice cube producing unit is configured to receive water and the water flows through the first plurality of compartments and the second plurality of compartments.

15. The ice cube producing unit of claim 1, further comprising at least one guiding element.

16. The ice cube producing unit of claim 15, wherein the at least one guiding element is a tapered protrusion or a tapered recess.

17. An ice cube producing unit comprising:

a frame including a first edge surrounding a first aperture, a second edge surrounding a second aperture, a rim extending between the first edge and the second edge, and an opening located on a portion of the rim, wherein the opening is configured to receive a closure element;

a first tray including a first plurality of compartments, wherein the first plurality of compartments have an interior-facing border and an exterior side;

a second tray including a second plurality of compartments, wherein the second plurality of compartments have an interior-facing border and an exterior side;

a first bi-stable element located between the first edge of the frame and the interior-facing border of the first tray, wherein the first bi-stable element extends around an entire periphery of the first tray, and a second bi-stable element located between the second edge of the frame and the interior-facing border of the second tray;

wherein the first bi-stable element secures the first tray to the first edge of the frame and the second bi-stable element secures the second tray to the second edge of the frame, and wherein at a first state, a distance between the interior-facing border of the first plurality of compartments and the interior-facing border of the second plurality of compartments has a first width, and at a second state, the distance between the interior-facing border of the first plurality of compartments and the interior-facing border of the second plurality of compartments has a second width, wherein the second width is greater than the first width.

18. The ice cube producing unit of claim 17, wherein the second bi-stable element extends around an entire periphery of the second tray.

19. An ice cube producing unit comprising:

a frame including a first edge surrounding a first aperture, a second edge surrounding a second aperture, a rim extending between the first edge and the second edge, and an opening located on a portion of the rim, wherein the opening is configured to receive a closure element;

a first tray including a first plurality of compartments, wherein the first plurality of compartments have an interior-facing border and an exterior side;

a second tray including a second plurality of compartments, wherein the second plurality of compartments have an interior-facing border and an exterior side;

a first bi-stable element located between the first edge of the frame and the interior-facing border of the first tray;

a second bi-stable element located between the second edge of the frame and the interior-facing border of the second tray;

wherein the first bi-stable element secures the first tray to the first edge of the frame and the second bi-stable element secures the second tray to the second edge of the frame, wherein at a first state, a distance between the interior-facing border of the first plurality of compartments and the interior-facing border of the second plurality of compartments has a first width, and at a second state, the distance between the interior-facing border of the first plurality of compartments and the interior-facing border of the second plurality of compartments has a second width, wherein the second width is greater than the first width, and wherein in the first state, at least one compartment of the first plurality of compartments corresponds to at least one compartment of the second plurality of compartments to form an ice cube compartment.

20. The ice cube producing unit of claim 19, wherein each compartment of the first plurality of compartments corresponds to a compartment of the second plurality of compartments to form a plurality of ice cube compartments.

* * * * *